US005232309A

United States Patent [19]

Pontynen

[11] Patent Number: 5,232,309

[45] Date of Patent: Aug. 3, 1993

[54] METHOD AND EQUIPMENT FOR MAINTAINING ICE-FREE LOCKS

[76] Inventor: Esko Pontynen, Poutuntie 13 A 17, SF-00400 Helsinki, Finland

[21] Appl. No.: 866,066

[22] Filed: Apr. 9, 1992

[30] Foreign Application Priority Data

Apr. 11, 1991 [FI] Finland ..... 905804

[51] Int. Cl.[5] ..... E02B 5/04; E02B 15/02

[52] U.S. Cl. ..... 405/61; 405/85

[58] Field of Search ..... 405/52, 53, 80, 84, 405/85, 86, 229, 61

[56] References Cited

U.S. PATENT DOCUMENTS

| | | | |
|---|---|---|---|
| 90,727 | 6/1869 | Chesebrough | 405/84 X |
| 1,662,113 | 3/1928 | Henry | 405/85 |
| 3,396,540 | 8/1968 | Aubert | 405/85 |
| 3,561,175 | 2/1971 | Best et al. | 405/229 X |
| 4,102,134 | 7/1978 | Margen | 405/53 |

*Primary Examiner*—David H. Corbin
*Attorney, Agent, or Firm*—Harrison & Egbert

[57] ABSTRACT

The method and equipment for keeping locks free of ice utilizes the natural energy resources of the waterway itself. Gravity is utilized to conduct warm water from the depths of the upper waterway via a pipe (1) into the lock where it is distributed by a network of pipes punctuated with holes (3) along the lock floor and around the lock gates. Cooled water is discharged through outlets (6) located in the lower lock gates or lock wall just below the level of the upper waterway. Warm water can effectively be brought to the surface by the use of compressed air conducted to the lock floor either through a special network of pipes or through the existing system (3). The piping may be laid on or under the lock floor. Heatloss can be reduced by insulating the sides of the lock and by fitting the lock with a cover the underside of which is coated with a heat-reflecting material. All the necessary equipment for maintaining an ice-free lock can be installed in both already existing and new locks, thus facilitating inland navigation all year round.

11 Claims, 1 Drawing Sheet

METHOD AND EQUIPMENT FOR MAINTAINING ICE-FREE LOCKS

The subject of the invention is a method and equipment for enabling locks to be kept open during winter, thus allowing all-year-round traffic on internal waterways for vessels specially equipped to travel through icy conditions.

It is nowadays possible for vessels specially constructed to cope with ice to navigate lakes. Before the channels opened up by such vessels freeze over again it is possible for other vessels not specially constructed to withstand ice to make use of them. However, locks cannot, at present, be operated in winter as the water in the lock basin freezes and the sluice gates are rendered inoperable.

Because locks cannot be kept in operation in winter, internal navigation is interrupted for the duration. This affects not only waterway traffic but also other forms of transport such as road and rail which are obliged to take over the transportation of cargoes normally carried by water and thus to maintain carrying capacity for this purpose which, once winter is over and internal navigation resumed, cannot be fully utilized.

By aid of the method and equipment proposed here, it would be possible to keep locks free also during the winter. The distinguishing features of the method and equipment relating to this invention are specified below in patent claims, claim 1.

The chief advantage of the invention is that it enables internal navigation throughout the year so that not only can it continue uninterrupted during the winter but it does not require assistance during that season from other forms of transport.

The invention is described in detail below by reference to the accompanying sketch.

Figure 1:
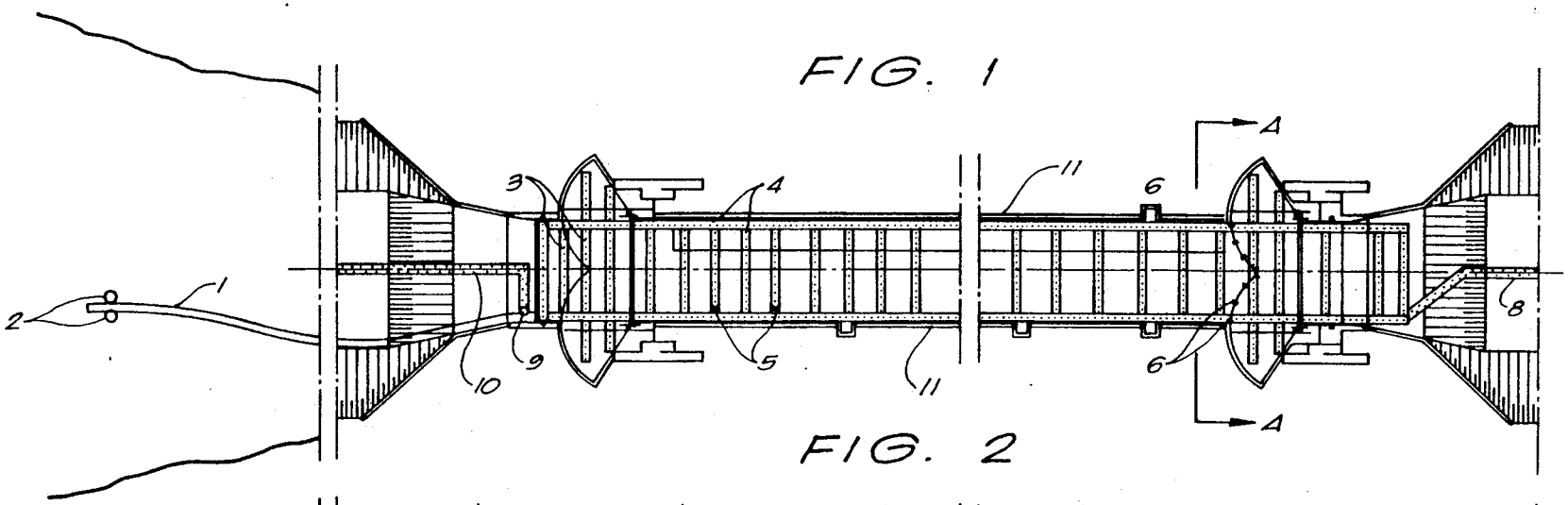
FIG. 1 shows the lock and part of the upper water level form above.
Figure 2:
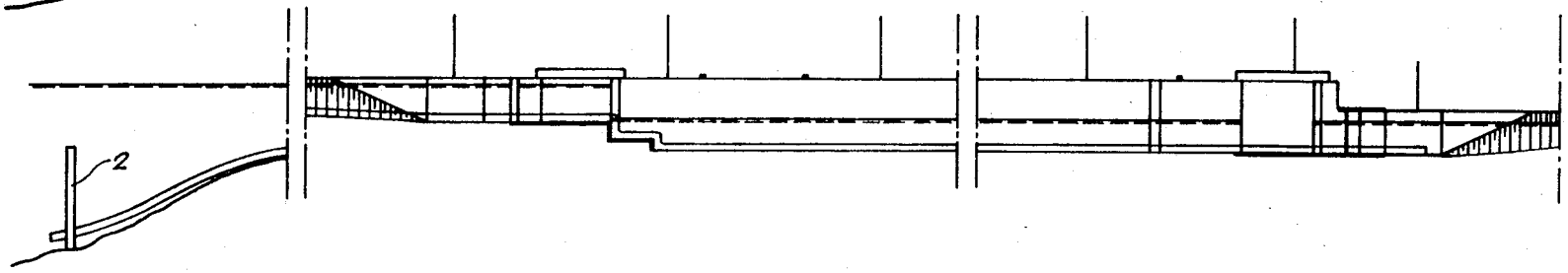
FIG. 2 shows a side elevation of the lock together with part of the upper water level.
Figure 3:
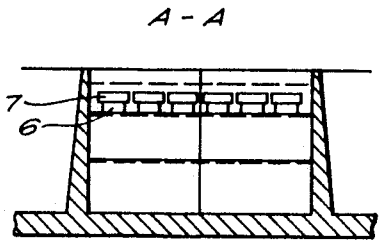
FIG. 3 shows a cross-section of the lock taken along line A—A of FIG. 1.

FIG. 1 shows, leading from the depths of the upper water level, one or more pipes 1 which run up to and in front of the upper sluice gates where, as at the bottom of the lock, they branch off to form a distribution network. At the source of the main pipe 1 deep in the water is equipment 2 which automatically regulates the upflow of water so that it is taken only from the warmest layer in the depths. The distribution pipes 3 contain holes 4 through which warm water flows along the lock bottom. The distribution pipes are also equipped with valves 5 by which the said flow of water can be regulated or, if needed, stopped altogether. As the water freezes in contact with the air it rises. The cooled water can then be expelled from the lock by being run off through outlets 6 in the lower sluice gate which, by virtue of their location below the upper water level, will allow a gravitational flow to take place without the need for any independent source of energy. The outlets 6 in the lower gates are fitted with sluices 7 which will generally be kept open. When a thin layer of ice forms on the lock surface, surface of the lock is run off through special outlets 6 built into the lower gates or wall of the lock.

In order to reduce the freezing of the lower channel after the lock, warm water may be conveyed also therein by force of gravity through a pipe 8 which may be a continuation of the main pipe 1. Pipe 8 is also equipped with holes and compressed air can be used to stimulate the warm water to be brought to the surface more quickly. Warm water can be conveyed also to the upper channel, before the lock, by a pump 9 which pumps water from the pipe 1 through pipe 10 equipped with holes. Also here the compressed air can be used to stimulate the circulation of warm water.

At a desired position in the lock floor or in front of the lock gates it would be possible to install further pipes through which compressed air could be blown. In this way warm water could be brought to the surface more quickly and prevent any freezing at the desired location, such as in front of the lock gates.

If there is no regular traffic through the lock, the removing of the cooled water can be enhanced by keeping the sluices predominantly closed and opening them from time to time so as to create a flow of water that will take the ice with it. The main feed pipe 1 and the distribution pipes 3 may alternatively be placed in the footing or in the walls of the lock. Similarly the outlets 6 and their accompanying sluices 7 could be located in the lock walls.

In order to reduce heatloss at the lock itself, insulation material 11 could be inserted vertically to frost penetration depth around the inside or outside edges of the lock. It would also be possible to insert insulation material 11 to the desired width horizontally around the edges of the lock close to the surface of the ground.

In order to prevent heatloss from the surface of the lock, the lock could be shielded by a cover of heat-reflecting material on the underside which could be drawn across a suitable supporting frame.

It is important to note that the method and equipment specified by this invention can be readily applied to locks already in existence. In the case of new locks the necessary equipment could largely be built into the structure itself.

I claim:

1. A method for keeping a lock free of ice comprising the steps of:

introducing warm water into a pipe opening in a bottom of an upper level of water outside of the lock;

conveying by gravity the warm water through the pipe to a network of distribution pipes, said distribution pipes having holes formed therein, said distribution pipes positioned on a floor of the lock;

passing the warm water from the distribution pipes through the holes so that warm water is delivered around the gates of the lock; and removing cooled water from the lock through outlets formed in the lower gates of the lock, said cool water passing to an area removed from the warm water and the pipe opening.

2. The method of claim 1, further comprising the step of:

channeling compressed air into the warm water as passed by the network of distribution pipes.

3. The method of claim 1, said step of introducing comprising:

selecting the warm water from the warmest layer of water in the upper layer of water outside of the lock.

4. The method of claim 1, further comprising the step of:

insulating an exterior surface of the lock below ground level.

5. The method of claim 1, further comprising the step of:

positioning the pipe opening in the bottom of the upper level of water such that the pipe opening lies below a level of the distribution pipes.

6. A system for the prevention of ice accumulation in a lock comprising:

a pipe opening in a bottom of an upper level of water outside of the lock, said pipe opening for receiving warm water;

a plurality of distribution pipes positioned in a floor of the lock, said distribution pipes having holes formed therein, said holes for allowing warm water to pass therethrough, said distribution pipes positioned adjacent to the gates of the lock; and an outlet positioned in a gate of the lock opposite the pipe opening, said outlet positioned below the level of the water in the lock.

7. The system of claim 6, further comprising:

a pump connected to said plurality of distribution pipes, said pump for passing compressed air into the distribution pipes.

8. The system of claim 6, further comprising:

a layer of insulating material affixed to the external surface of the lock.

9. The system of claim 6, said gate opposite the pipe opening having a plurality of sluices affixed thereto, said sluices positioned above said outlet.

10. The system of claim 6, said pipe opening movable so as to receive warm water from the warmest layer of water.

11. The system of claim 6, said pipe opening positioned below the level of the distribution pipes in the lock, the warm water passing to said distribution pipes by action of gravity.

* * * * *